US010788220B2

(12) United States Patent
Blum et al.

(10) Patent No.: US 10,788,220 B2
(45) Date of Patent: Sep. 29, 2020

(54) DETERMINING COOKWARE LOCATION ON A COOKTOP APPLIANCE BASED ON TEMPERATURE RESPONSE

(71) Applicant: Haier US Appliance Solutions, Inc., Wilmington, DE (US)

(72) Inventors: Michael Blum, Louisville, KY (US); James Lee Armstrong, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 258 days.

(21) Appl. No.: 16/034,410

(22) Filed: Jul. 13, 2018

(65) Prior Publication Data

US 2020/0018487 A1 Jan. 16, 2020

(51) Int. Cl.

| | |
|---|---|
| ***H05B 3/68*** | (2006.01) |
| ***H05B 6/12*** | (2006.01) |
| ***H05B 1/02*** | (2006.01) |
| ***F24C 7/08*** | (2006.01) |
| ***H05B 6/06*** | (2006.01) |

(52) U.S. Cl.

CPC ..... *F24C 7/083* (2013.01); *H05B 6/06* (2013.01); *H05B 6/062* (2013.01)

(58) Field of Classification Search

CPC .. F24C 7/08; F24C 7/081; F24C 7/082; F24C 7/083; H05B 6/00; H05B 6/02; H05B 6/06; H05B 6/062; H05B 3/746

USPC ..... 219/620–627, 518

See application file for complete search history.

(56) References Cited

U.S. PATENT DOCUMENTS

| | | | | |
|---|---|---|---|---|
| 9,769,883 | B2 | 9/2017 | Hashimoto et al. | |
| 2008/0237215 | A1* | 10/2008 | Lee | F24C 15/105 219/447.1 |
| 2014/0295357 | A1 | 10/2014 | McAfee et al. | |
| 2016/0095169 | A1 | 3/2016 | Sanchez | |
| 2017/0122569 | A1 | 5/2017 | Johnson et al. | |
| 2017/0339751 | A1* | 11/2017 | Meng | G01K 1/143 |

FOREIGN PATENT DOCUMENTS

| | | |
|---|---|---|
| CN | 103493587 | 1/2014 |
| CN | 104302029 | 1/2015 |
| CN | 104771085 | 7/2015 |
| CN | 105455603 | 4/2016 |
| CN | 205191668 | 4/2016 |
| EP | 0780081 B1 | 12/2001 |

OTHER PUBLICATIONS

International Search Report, PCT Application No. PCT/CN2019/094660, dated Oct. 9, 2019, 2 pages.

* cited by examiner

*Primary Examiner* — Sang Y Paik
(74) *Attorney, Agent, or Firm* — Dority & Manning, P.A.

(57) ABSTRACT

A cooktop appliance includes first and second heating elements and a controller operably connected to the first and second heating elements. The controller is configured for receiving a signal from a temperature sensor associated with a cooking utensil. The controller is also configured for activating the first heating element at a heating level that is higher than a heating level of the second heating element for a testing period, and monitoring the temperature associated with the cooking utensil during the testing period. The controller is configured for determining that the cooking utensil is located on the first heating element when a value of the monitored temperature is greater than a predefined threshold.

20 Claims, 5 Drawing Sheets

DETERMINING COOKWARE LOCATION ON A COOKTOP APPLIANCE BASED ON TEMPERATURE RESPONSE

FIELD

The present subject matter relates generally to cooktop appliances, or more particularly to methods for operating cooktop appliances.

BACKGROUND

Cooktop appliances generally include heating elements for heating cooking utensils, such as pots, pans and griddles. A user can select a desired heating level, and operation of the heating elements is modified to match the desired heating level. For example, certain cooktop appliances include electric heating elements. During operation, such a cooktop appliance operates the electric heating elements at a predetermined power output corresponding to a selected heating level. As another example, some cooktop appliances include gas burners as heating elements. In operation of such example cooktop appliances, a predetermined flow rate of gas to the burner may correspond to the selected heating level.

Operating the heating elements at the predetermined level, e.g., power output, fuel flow rate, etc., corresponding to the selected heating level poses certain challenges. For example, the predetermined level is only an indirect measurement of the actual cooking temperature. Some cooktop appliances employ a temperature sensor to directly measure the temperature of a cooking utensil and/or articles contained within the cooking utensil. The measured temperature may then be used to adjust the heating level above or below the predetermined level in order to achieve a cooking temperature closer to the selected heating level.

However, in some instances the cooking utensil with the temperature sensor may be misplaced. For example, the cooking utensil with the temperature sensor may be located on a heating element other than the heating element which is adjusted based on the measured temperature. Further, the cooking utensil with the temperature sensor may be a first cooking utensil and a second cooking utensil may be located on the heating element which is adjusted based on the measured temperature of the first cooking utensil. In such cases, the articles in the first cooking utensil may not be heated as desired and the power output of the heating element which is adjusted based on the measured temperature may be adjusted to a level that is unsuitable for the second cooking utensil and/or articles therein, which can degrade the cooking performance of the cooktop appliance.

Accordingly, a cooktop appliance with features for avoiding such degraded cooking performance would be useful. In particular, a cooktop appliance with features for determining or verifying that a cooking utensil with a temperature sensor corresponds to or is correctly located on the heating element of the cooktop appliance which is controlled based on measurements from the temperature sensor would be particularly beneficial.

BRIEF DESCRIPTION OF THE INVENTION

Aspects and advantages of the invention will be set forth in part in the following description, or may be apparent from the description, or may be learned through practice of the invention.

In an exemplary aspect of the present disclosure, a cooktop appliance is provided. The cooktop appliance includes first heating element and a second heating element. The first and second heating elements are positioned at a cooktop surface of the cooktop appliance. The cooktop appliance also includes a controller operably connected to the first and second heating elements. The controller is configured for receiving a signal from a temperature sensor associated with a cooking utensil located on one of the first heating element and the second heating element. The signal is indicative of a temperature associated with the cooking utensil. The controller is also configured for activating the first heating element for a testing period and monitoring the temperature associated with the cooking utensil during the testing period. The controller is further configured for determining that the cooking utensil is located on the first heating element when a value of the monitored temperature is greater than a predefined threshold.

In another exemplary aspect, a method of operating a cooktop appliance is provided. The cooktop appliance has a first heating element and a second heating element positioned at a cooking surface of the cooktop appliance. The method includes receiving a signal from a temperature sensor associated with a cooking utensil located on one of the first heating element and the second heating element. The signal is indicative of a temperature associated with the cooking utensil. The method also includes activating the first heating element for a testing period and monitoring the temperature associated with the cooking utensil during the testing period. The method further includes determining that the cooking utensil is located on the first heating element when a value of the monitored temperature is greater than a predefined threshold.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
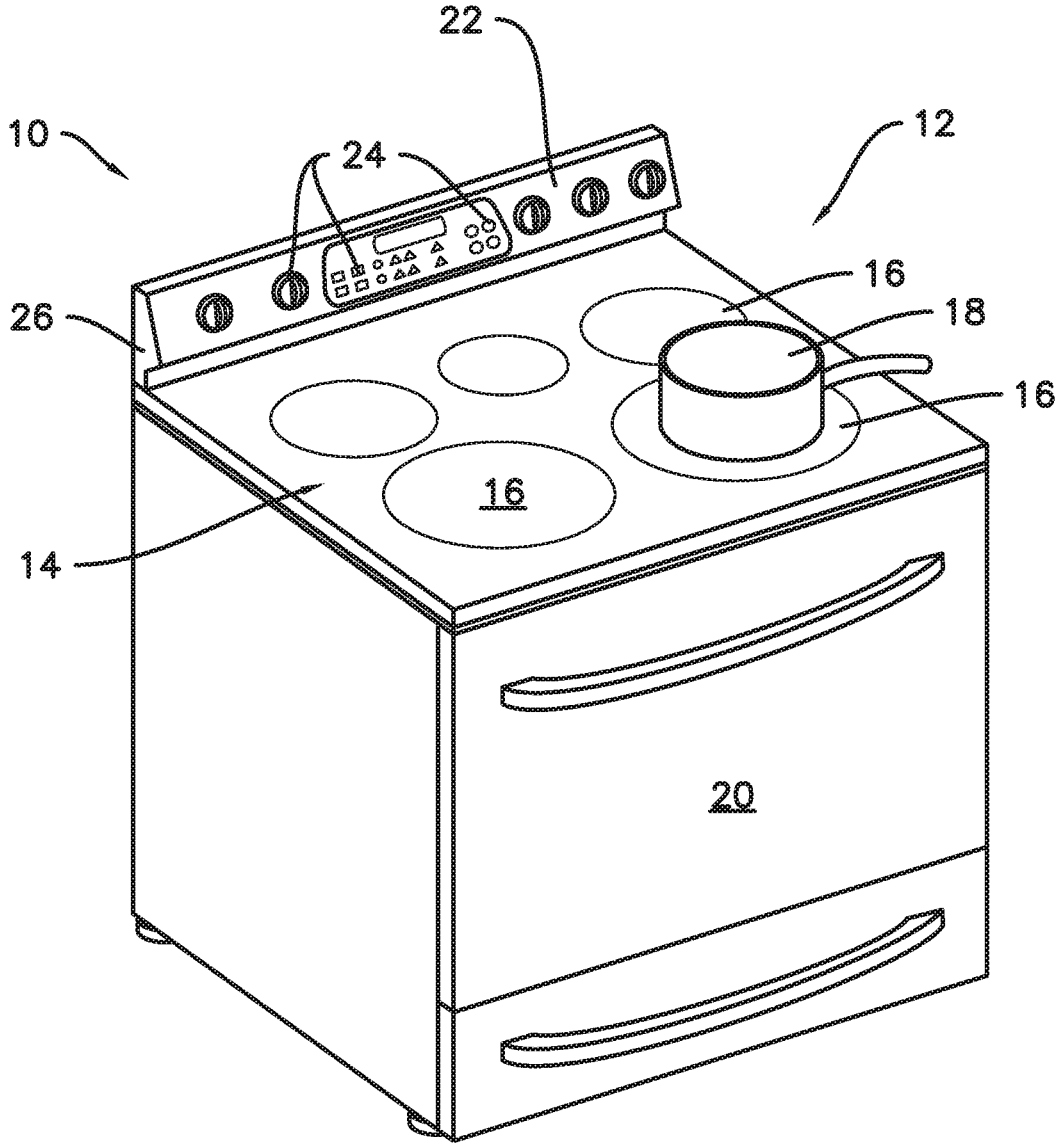
FIG. 1 provides a perspective view of a range having a cooktop appliance according to one or more exemplary embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "generally," or "about" include values within ten percent greater or less than the stated value. When used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

FIG. 1 provides a perspective view of a range appliance, or range 10, including a cooktop 12. Range 10 is provided by way of example only and is not intended to limit the present subject matter to the arrangement shown in FIG. 1. Thus, the present subject matter may be used with other range 10 and/or cooktop 12 configurations, e.g., double oven range appliances, standalone cooktop appliances, cooktop appliances without an oven, etc.

A cooking surface 14 of cooktop appliance 12 includes a plurality of heating elements 16. For the embodiment depicted, the cooktop 12 includes five heating elements 16 spaced along cooking surface 14. The heating elements 16 are generally positioned at, e.g., on or proximate to, the cooking surface 14. In certain exemplary embodiments, cooktop 12 may be a radiant cooktop with resistive heating elements or coils mounted below cooking surface 14. However, in other embodiments, the cooktop appliance 12 may include any other suitable shape, configuration, and/or number of heating elements 16. For example, in various embodiments, the cooktop appliance 12 may include any other suitable type of heating element 16, such as an induction heating element or gas burners, etc. Each of the heating elements 16 may be the same type of heating element 16, or cooktop appliance 12 may include a combination of different types of heating elements 16.

As shown in FIG. 1, a cooking utensil 18, such as a pot, pan, or the like, may be placed on a heating element 16 to heat the cooking utensil 18 and cook or heat food items placed in cooking utensil 18. Range appliance 10 also includes a door 20 that permits access to a cooking chamber (not shown) of range appliance 10, e.g., for cooking or baking of food items therein. A control panel 22 having controls 24 permits a user to make selections for cooking of food items. Although shown on a backsplash or back panel 26 of range appliance 10, control panel 22 may be positioned in any suitable location. Controls 24 may include buttons, knobs, and the like, as well as combinations thereof, and/or controls 24 may be implemented on a remote user interface device such as a smartphone, as described below. As an example, a user may manipulate one or more controls 24 to select a temperature and/or a heat or power output for each heating element 16. The selected temperature or heat output of heating element 16 affects the heat transferred to cooking utensil 18 placed on heating element 16.

As will be discussed in greater detail below, the cooktop appliance 12 includes a control system 50 (FIG. 3) for controlling one or more of the plurality of heating elements 16. Specifically, the control system 50 may include a controller 52 (FIGS. 2 and 3) operably connected to the control panel 22 and controls 24. The controller 52 may be operably connected to each of the plurality of heating elements 16 for controlling a heating level each of the plurality of heating elements 16 in response to one or more user inputs received through the control panel 22 and controls 24.

Figure 2:
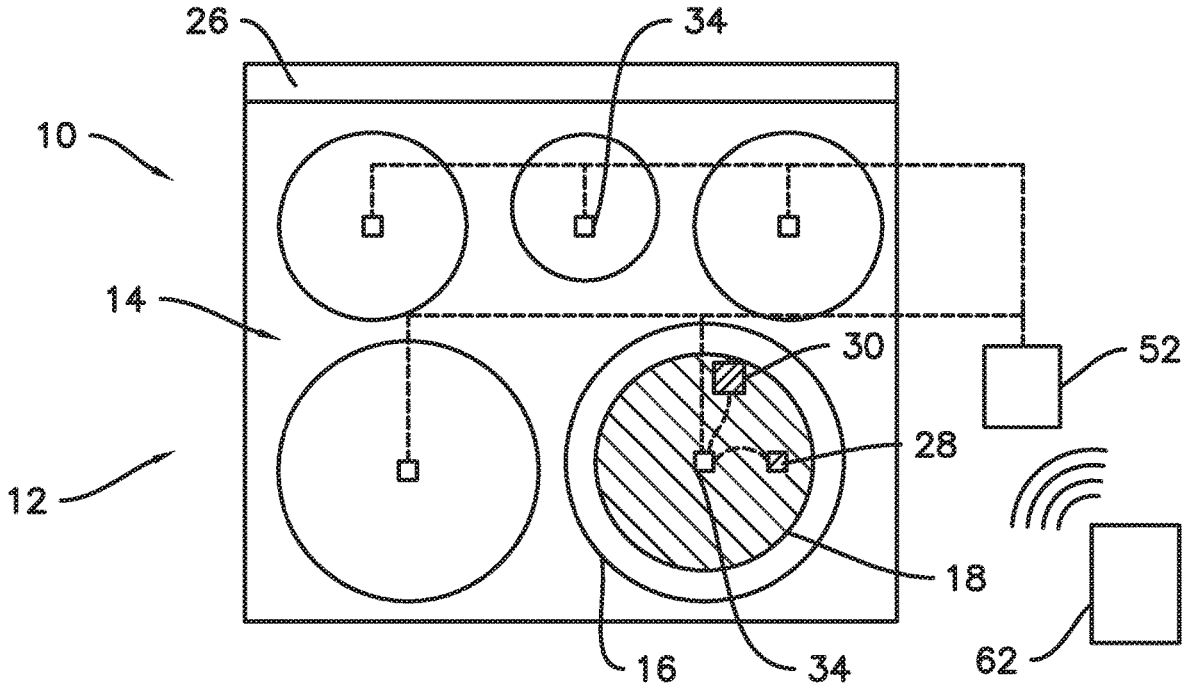
FIG. 2 provides a top, schematic view of the exemplary cooktop appliance of FIG. 1.

Referring now to FIG. 2, a top, schematic view of the cooktop 12 of FIG. 1, or more specifically of the cooking surface 14 of the cooktop 12 of FIG. 1, is provided. As stated, the cooking surface 14 of the cooktop 12 for the embodiment depicted includes five heating elements 16 spaced along the cooking surface 14. A cooking utensil 18, also depicted schematically, is positioned on a first heating element 16 of the plurality of heating elements 16. For the embodiment depicted, a cookware temperature sensor 28 and a food temperature sensor 30 are also associated with the cooking utensil 18.

Figure 3:
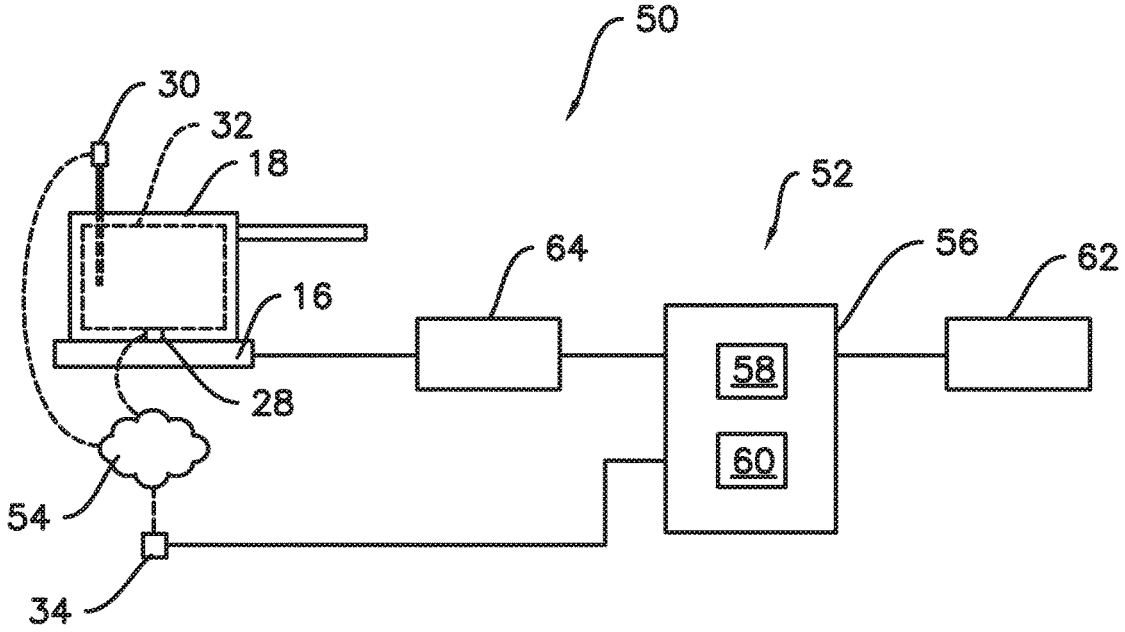
FIG. 3 provides a schematic diagram of a control system as may be used with the exemplary cooktop appliance of FIG. 2.

In some example embodiments, the cookware temperature sensor 28 may be in contact with, attached to, or integrated into the cooking utensil 18 and configured to sense a temperature of, e.g., a bottom surface of the cooking utensil 18 or bottom wall of the cooking utensil 18. For example, the cookware temperature sensor 28 may be embedded within the bottom wall of the cooking utensil 18 as illustrated in FIG. 3. Alternatively, cookware temperature sensor 28 may be embedded within a side wall of the cooking utensil 18, e.g., proximate to the bottom surface or bottom wall of the cooking utensil 18.

Additionally, the food temperature sensor 30 may be positioned at any suitable location to sense a temperature of one or more food items 32 (see FIG. 3) positioned within the cooking utensil 18. For example, the food temperature sensor 30 may be a probe type temperature sensor configured to be inserted into one or more food items 32. Alternatively, however, the food temperature sensor 30 may be configured to determine a temperature of one or more food items positioned within the cooking utensil 18 in any other suitable manner.

In certain exemplary embodiments, one or both of the cookware temperature sensor 28 and the food temperature sensor 30 may utilize any suitable technology for sensing/determining a temperature of the cooking utensil 18 and/or food items 32 positioned in the cooking utensil 18. The cookware temperature sensor 28 and the food temperature sensor 30 may measure a respective temperature by contact and/or non-contact methods. For example, one or both of the cookware temperature sensor 28 and the food temperature sensor 30 may utilize one or more thermocouples, thermistors, optical temperature sensors, infrared temperature sensors, resistance temperature detectors (RTD), etc.

Referring again to FIGS. 2 and 3, the cooktop appliance 12 additionally includes at least one receiver 34. In the illustrated example of FIG. 2, the cooktop appliance 12 includes a plurality of receivers 34, each receiver 34 associated with an individual heating element 16. Each receiver 34 is configured to receive a signal from the food temperature sensor 30 indicative of a temperature of the one or more food items 32 positioned within the cooking utensil 18 and/or from the cookware temperature sensor 28 indicative of a temperature of the cooking utensil 18 positioned on a respective heating element 16. In other embodiments, a single receiver 34 may be provided and the single receiver 34 may be operatively connected to one or more than one of the sensors. In at least some exemplary embodiments, one or both of the cookware temperature sensor 28 and the food temperature sensor 30 may include wireless transmitting capabilities, or alternatively may be hard-wired to the receiver 34, e.g., through a wired communications bus.

FIG. 3 provides a schematic view of a system for operating a cooktop appliance 12 in accordance with an exemplary embodiment of the present disclosure. Specifically, FIG. 3 provides a schematic view of a heating element 16 of the exemplary cooktop appliance 12 of FIGS. 1 and 2 and an exemplary control system 50.

As stated, the cooktop appliance 12 includes a receiver 34 associated with one or more of the heating elements 16, for example a plurality of receivers 34 each associated with a respective heating element 16. For the embodiment depicted, each receiver 34 is positioned directly below a center portion of a respective heating element 16. Moreover, for the embodiment depicted, each receiver 34 is configured as a wireless receiver 34 configured to receive one or more wireless signals. Specifically, for the exemplary control system 50 depicted, both of the cookware temperature sensor 28 and the food temperature sensor 30 are configured as wireless sensors in wireless communication with the wireless receiver 34 via a wireless communications network 54. In certain exemplary embodiments, the wireless communications network 54 may be a wireless sensor network (such as a Bluetooth communication network), a wireless local area network (WLAN), a point-to point communication networks (such as radio frequency identification (RFID) networks, near field communications networks, etc.), a combination of two or more of the above communications networks, or any suitable wireless communications network or networks.

Referring still to FIG. 3, each receiver 34 associated with a respective heating element 16 is operably connected to a controller 52 of the control system 50. The receivers 34 may be operably connected to the controller 52 via a wired communication bus (as shown), or alternatively through a wireless communication network similar to the exemplary wireless communication network 54 discussed above. The controller 52 may generally include a computing device 56 having one or more processor(s) 58 and associated memory device(s) 60. The computing device 56 may be configured to perform a variety of computer-implemented functions to control the exemplary cooktop appliance 12. The computing device 56 can include a general purpose computer or a special purpose computer, or any other suitable computing device. It should be appreciated, that as used herein, the processor 58 may refer to a controller, a microcontroller, a microcomputer, a programmable logic controller (PLC), an application specific integrated circuit, and other programmable circuits. Additionally, the memory device(s) 60 may generally comprise memory element(s) including, but not limited to, computer readable medium (e.g., random access memory (RAM)), computer readable non-volatile medium (e.g., a flash memory), a compact disc-read only memory (CD-ROM), a magneto-optical disk (MOD), a digital versatile disc (DVD), and/or other suitable memory elements. The memory 60 can store information accessible by processor(s) 58, including instructions that can be executed by processor(s) 58. For example, the instructions can be software or any set of instructions that when executed by the processor(s) 58, cause the processor(s) 58 to perform operations. For the embodiment depicted, the instructions may include a software package configured to operate the system, e.g., to execute the exemplary methods described below.

Referring still to FIG. 3, the control system 50 additionally includes a user interface 62 operably connected to the controller 52. For the embodiment depicted, e.g., in FIG. 3, the user interface 62 is configured in wired communication with the controller 52. However, in other exemplary embodiments, e.g., as shown in FIG. 2, the user interface 62 may additionally or alternatively be wirelessly connected to the controller 52 via one or more suitable wireless communication networks (such as the exemplary wireless communication network 54 described above). In certain exemplary embodiments, user interface 62 may be configured as the control panel 22 and plurality of controls 24 on the cooktop appliance 12 (see FIG. 1). Additionally, or alternatively, the user interface 62 may be configured as an external computing device or remote user interface device, such as a smart phone, tablet, or other device capable of connecting to the controller 52 of the exemplary control system 50. For example, in some embodiments, the remote user interface may be an application or "app" executed by a remote user interface device such as a smart phone or tablet. Signals generated in controller 52 operate the cooktop 12 in response to user input via the user interface 62.

Further, the controller 52 is operably connected to each of the plurality of heating elements 16 for controlling a heating level of each of the plurality of heating elements 16 in response to one or more user inputs through the user interface 62 (e.g., control panel 22 and controls 24). In various embodiments, controlling the heating level of the heating elements may include controlling a supply of electric power to the heating elements, a supply of fuel to the heating elements, etc. For example, wherein one or more of the heating elements 16 are configured as electric resistance heaters, the controller 52 may be operably connected to respective relays controlling a supply of power to such electrical resistance heaters. Alternatively, in embodiments wherein one or more of the heating elements 16 are configured as induction heating elements, the controller 52 may be operably connected to respective current control devices. As another example, in embodiments wherein one or more of the heating elements 16 are configured as gas burners, the controller 52 may be operably connected to a valve in a fuel supply line of each gas burner and/or an actuator of such fuel supply valve to control a supply, e.g., a flow rate, of fuel to the respective burner.

Figure 4:
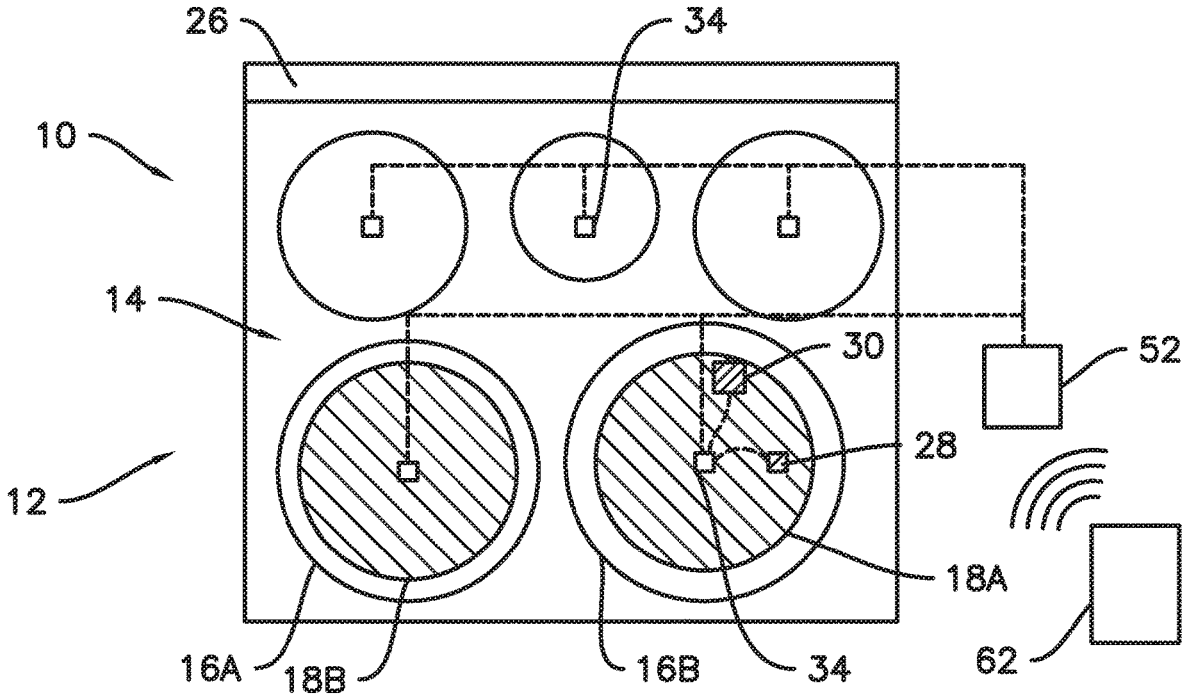
FIG. 4 provides an additional top, schematic view of the exemplary cooktop appliance of FIG. 1.

Turning now to FIG. 4, a first cooking utensil 18A is illustrated, which may include one or both of the cookware temperature sensor 28 and the food temperature sensor 30, e.g., as in any one or combination of the above-described examples. Also shown in FIG. 4 is a second cooking utensil 18B. As shown in FIG. 4, the heating element which is controlled in response to measured temperature by the temperature sensor(s) 28 and/or 30, may be a first heating element 16A, and the cooktop 12 may also include a second heating element 16B. With such exemplary cooktops 12, one or more cooking utensils may be misplaced. For example, as illustrated in FIG. 4, the first and second cooking utensils 18A and 18B are both misplaced. The first cooking utensil 18A is not placed on the first heating element 16A, which is controlled in response to temperature measurements from the temperature sensor(s) 28 and/or 30 located in first cooking utensil 18A, such that the intended responsive heating is not provided to first cooking utensil 18A and articles therein. As used herein and as is generally understood in the art, a utensil "on" a heating element is positioned in close proximity to the heating element sufficient to be heated by the heating element, e.g., in thermal communication in embodiments including a resistance heating element or a gas burner heating element, or within the magnetic field of an induction heating element in some embodiments, but the utensil is not necessarily in direct physical contact with the heating element to be "on" the heating element. The second cooking utensil 18B is also misplaced in that the second cooking utensil 18B and articles therein may be heated by the first heating element 16A at a level which is responsive to a temperature other than the actual temperature of the second cooking utensil 18B and any food articles 32 therein, e.g., the temperature measured by the sensor(s) 28 and/or 30 in the first utensil 18A.

In some embodiments, the controller 52 may be configured to receive a signal from a temperature sensor associated with the first cooking utensil 18A when the first cooking utensil 18A is located on one of the first heating element 16A and the second heating element 16B. For example, the signal may be received from the sensor via the receiver 34 as described above. The temperature sensor may be associated with the cooking utensil 18 in that the temperature sensor is positioned and configured to sense a temperature of the cooking utensil 18 itself, such as the cookware temperature sensor 28, and/or a temperature of the contents of the cooking utensil, such as the food temperature sensor 30. In order to confirm that the first cooking utensil 18A is located on the first heating element 16A, the controller 52 may further be configured to determine the location of the first cooking utensil 18A based on the temperature response measured via the temperature sensor(s) 28 and/or 30.

For example, in some embodiments, the controller 52 may be configured to activate the first heating element at a first heating level, e.g., at a heating level that is higher than a heating level of the second heating element 16B, for a testing period. In various embodiments, the second heating element 16B may be deactivated or activated at a low heating level during the testing period. The first heating level may advantageously be the ordinary heating level corresponding to a user-selected heating level. In such embodiments, the location of the first cooking utensil 18A can be determined or confirmed with a minimal or no interruption in the desired cooking operation. The controller 52 may also be configured to monitor the temperature associated with the first cooking utensil 18A, e.g., the temperature of the first cooking utensil 18A itself and/or a temperature of the contents of the first cooking utensil 18A during the testing period. Thus, the controller 52 may determine that the cooking utensil is located on the first heating element when a value of the monitored temperature is greater than a predefined threshold. In various embodiments, the value of the monitored temperature may be one or more of a net increase in the monitored temperature, a rate of increase in the monitored temperature, and/or an integral of the monitored temperature. For example, the integral of the monitored temperature may represent the area under a time/temperature curve, such that the integral of the monitored temperature greater than the predefined threshold indicates that the monitored temperature has reached at least a threshold temperature and/or has remained at or above the threshold temperature for a minimum amount of time.

Once it has been determined that the first cooking utensil 18A and the associated temperature sensor(s) 28 and/or 30 are located on the first heating element 16A, the controller 52 may then operate the first heating element 16A in response to the measured temperature, e.g., by adjusting a heating level of the first heating element 16A based on the received signal from the temperature sensor(s) 28 and/or 30. In some embodiments, when the value of the monitored temperature is less than the predefined threshold, e.g., where the monitored temperature never reaches the predefined threshold before the testing period elapses, the controller 52 may also be configured to deactivate the first heating element 16A. In such cases, the controller 52 may further be configured to provide a notification such as an error message or alert, e.g., via user interface 62, when the value of the monitored temperature is less than the predefined threshold.

As mentioned above, the first heating level may advantageously be the ordinary heating level corresponding to a user-selected heating level. In general, it may be advantageous to operate the heating element(s) at or as close as possible to an ordinary level during the testing period. One of skill in the art will recognize that the "ordinary" heating level is the level at which the heating element would be operated when each intended cooking utensil is placed on the intended heating element. For example, the ordinary heating level may be the heating level provided for cooking operation in response to the user-selected heating level. In such examples, the controller 52 may be further configured for generating a temperature setting. For example, the cooktop appliance 12 and/or a controller 52 thereof may be configured to generate the temperature setting in response to a user input received via the user interface 62 (FIG. 3). In such embodiments, activating the first heating element 16A at the first level during the testing period may include setting a heating level of the first heating element 16A to an ordinary level associated with the generated temperature setting. In other embodiments, the first heating level during the testing period may also or instead include a variable heating level based on the measured temperature, e.g., using a closed control loop such as a PI or PID control. For example, the first heating level during the testing period may initially include the ordinary level which may then be modified or varied based on the PID control. Thus, in some embodiments, the ordinary level may include a variable level which is adjusted based on the output of a closed control loop.

In some embodiments, activating the first heating element 16A for the testing period may include setting a heating level of the first heating element 16A to an ordinary level corresponding to a user-selected low setting. As mentioned, the second heating element 16B (and any additional heating elements, such as the third, fourth, and fifth heating elements illustrated, e.g., in FIG. 2) may be deactivated for the testing period, in particular when user-selected setting for the first heating element 16A is a low or medium setting. In various embodiments, any suitable combination of heating levels may be applied, e.g., where the difference between heating levels is large enough to provide a measurable temperature response.

The testing period may comprise any suitable duration which is sufficient to distinguish whether the measured temperature response of the first cooking utensil 18A does or does not correspond to the expected temperature response. For example, the necessary time to make such a determination may depend on the heating level of the first heating element 16A, e.g., it may be possible to more quickly determine that the first cooking utensil 18A is not being heated by the first heating element 16A when the first heating element 16A is operating at a high heating level. Accordingly, in various embodiments, the duration of the testing period may correspond to the first heating level, e.g., the duration may be shorter when the generated temperature setting is a high setting. For example, the duration of the testing period may be determined from a lookup table where the first heating level, e.g., the generated temperature setting, can be looked up in the table to determine a corresponding duration of the testing period.

As used herein with respect to user selections, terms such as "low," "medium," and "high" are understood relative to one another and in the context of a maximum possible heat output or heating level of the heating element. For example, the user may select a high setting, and the corresponding ordinary heating level may include operating the heating element at or above about sixty-seven percent (67%) of its heat output capacity, such as about seventy-five percent (75%) or more, such as about eighty-five percent (85%) or more, such as about ninety-five percent (95%) or more. In various embodiments, such percentages or levels may correspond to a power level, such as voltage applied or current supplied to the heating element, or a fuel supply rate. For example, a user-selectable low setting may correspond to an ordinary heating level of about one thousand eight hundred Watts (1800 W), a user-selectable medium setting may correspond to an ordinary heating level of about two thousand five hundred Watts (2500 W), and a user-selectable high setting may correspond to an ordinary heating level of about three thousand seven hundred Watts (3700 W). As another example, in the case of a gas burner, a low setting may correspond to a heating level with a fuel supply valve position of about thirty-three percent (33%) open or less, such as about ten percent (10%) open or less, a medium setting may correspond to a heating level with a valve position of between about thirty-three percent (33%) and about seventy-five percent (75%) open, and a high setting may correspond to a heating level with a valve position of about seventy-five percent (75%) open or more.

In various embodiments, the duration of the testing period may be less than about ten seconds, such as about five seconds or less, such as about three seconds or less. In such embodiments, it may be advantageous to provide a short duration for the testing period to avoid or minimize disruption of cooking operations on the second heating element 16B (and/or other heating elements than the first heating element 16A, such as a third, fourth, etc. heating element). A short duration of the testing period, e.g., about five seconds or less, may be particularly advantageous when the second heating element 16B is deactivated during the testing period. Moreover, where the second heating element 16B is deactivated and in other embodiments where there is a large difference between the heating level of the first heating element 16A and the heating level of the second heating element 16B, the determinative value of the measured temperature may reach the predefined threshold, if at all, in a relatively short time. For example, a determination whether the measured temperature more closely matches a temperature response of a cooking utensil on the first heating element 16A or a temperature response of a cooking utensil on the second heating element 16B may be quickly and easily made when there is a large difference between the heating level of the first heating element 16A and the heating level of the second heating element 16B.

Figure 5:
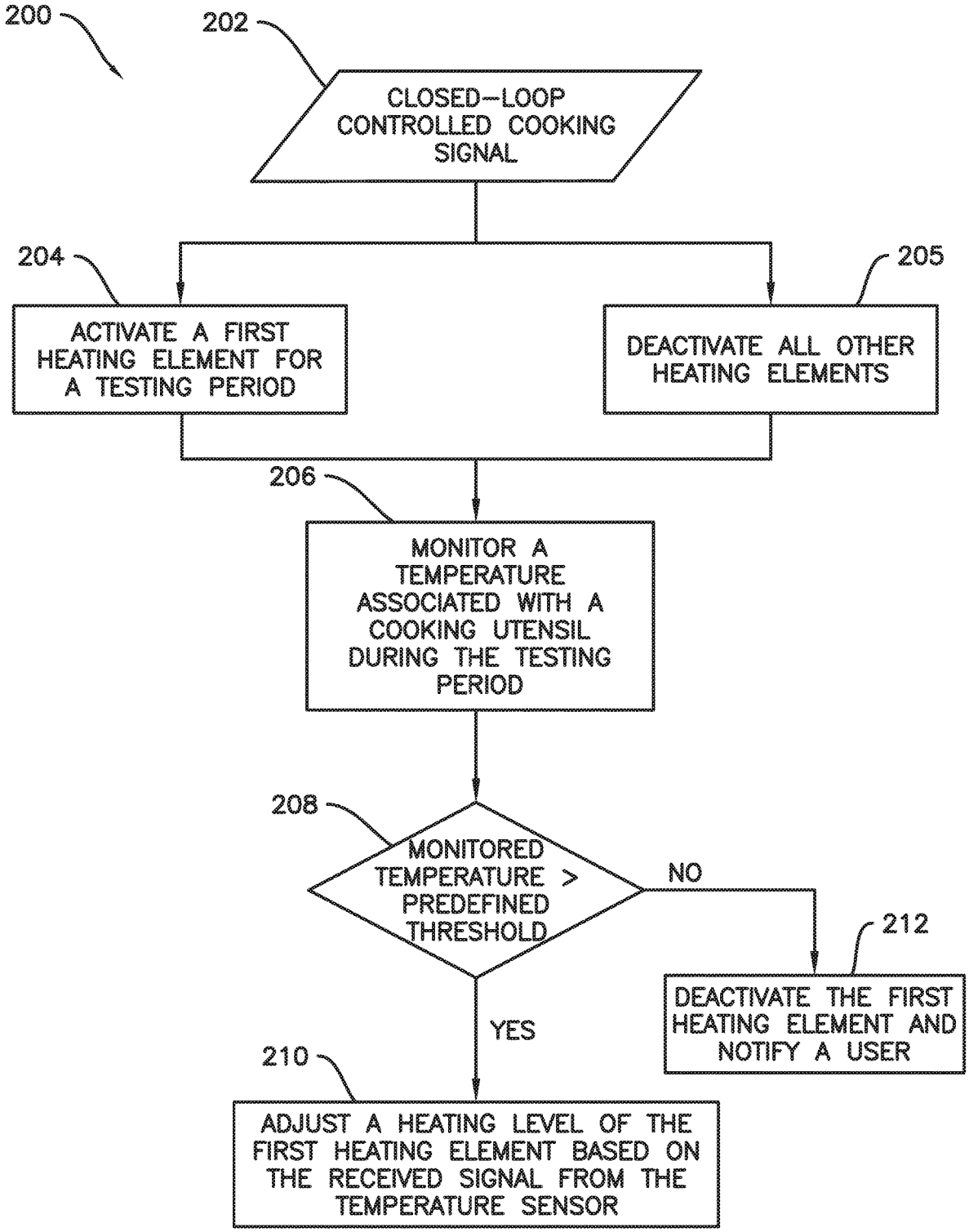
FIG. 5 provides a flow chart of an exemplary method of operating a cooktop appliance.

FIG. 5 illustrates an exemplary method 200 of operating a cooktop appliance, such as the exemplary cooktop 12. In some embodiments, the controller 52 may be configured to perform some or all of the steps of method 200. The method 200 may initially include receiving a signal 202, the signal 202 received from the control panel or one or more controls of a plurality of controls. The signal 202 may be indicative of an intent to perform a closed-loop controlled cooking operation on a specific burner, e.g., first heating element 16A, with a specific item of cookware, e.g., first cooking utensil 18A. The method 200 may also include a step 204 of activating the first heating element 16A for a testing period and a step 205 of deactivating all other heating elements for the testing period.

The method 200 may further include a step 206 of monitoring the temperature associated with the cooking utensil during the testing period, e.g., with a temperature sensor. The temperature may be monitored with one or both of the cookware temperature sensor 28 and the food temperature sensor 30, e.g., temperature values may be continuously measured by the temperature sensor(s) 28 and/or 30 over the testing period. Thus, it should be understood that "monitored," "monitoring," or other cognates thereof as used herein include continuous or repeated measuring or sampling of data, e.g., temperature, over a period of time. Further, in various embodiments, the temperature sensor used in the monitoring steps, e.g., step 206, may be one or both of the cookware temperature sensor 28 and the food temperature sensor 30, and the monitored temperature may be one or both of a temperature of the first cooking utensil 18A and a temperature of food item 32.

The method 200 may also include, at step 208, determining whether a value of the monitored temperature is greater than a predefined threshold. If so, it may be determined that the cooking utensil is located on the first heating element. After determining that the cooking utensil is located on the first heating element 16A, the method 200 may include a step 210 of adjusting a heating level of the first heating element 16A based on the received signal from the temperature sensor, e.g., by inputting the temperature signal into a closed control loop and adjusting the heating level based on the output of the control loop. When the value of the monitored temperature is less than the predefined threshold, the method 200 may include a step 212 of deactivating the first heating element and providing a notification.

Figure 6:
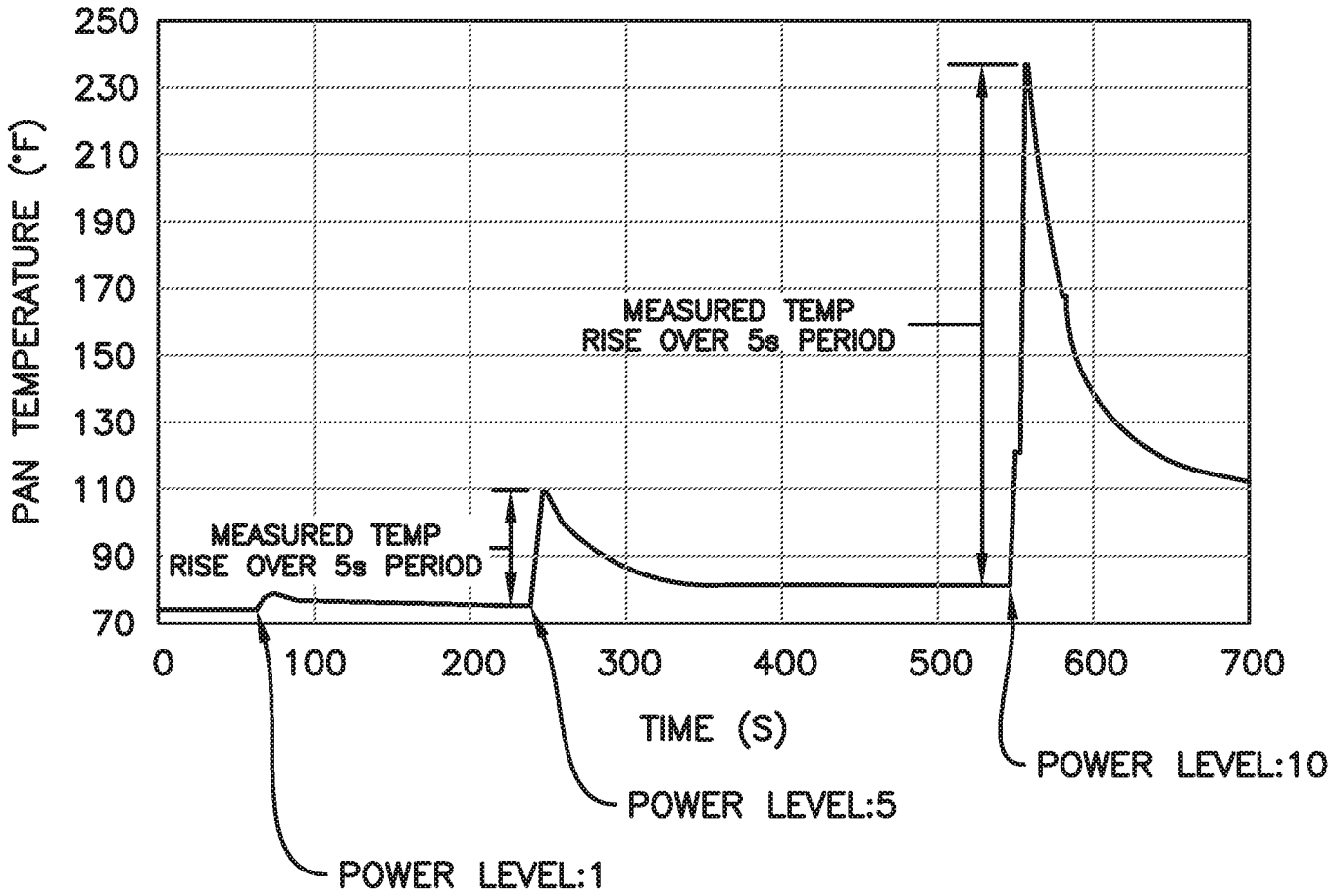
FIG. 6 provides a graph of an example temperature response of a cooking utensil over a testing period according to one or more embodiments of the present subject matter.

FIG. 6 provides a graph of an example temperature response of a cooking utensil over a testing period. In some embodiments, the testing period may be five seconds (5 s, as noted in FIG. 6). FIG. 6 illustrates various embodiments wherein the temperature response indicates that the cooking utensil 18A is located on the first heating element 16A. As shown in FIG. 6, the value of the monitored temperature may be a temperature rise over the testing period. In various embodiments, the predefined threshold may depend on the heating level. For example, as shown in FIG. 6, the temperature rise which indicates the cooking utensil 18A is located on the intended first heating element 16A is relatively small when the heating level, e.g., the ordinary power level of the heating element 16A which may in this embodiment be a resistance heating element, is set to power level 1, for example, corresponding to a user-selected low setting. Also shown in FIG. 6 are power level 5, which may correspond to a user-selected medium setting, and a power level 10, which may correspond to a user-selected high setting. As can be seen in FIG. 6, the predefined threshold may be correspondingly higher when the heating level is higher.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooktop appliance, comprising:

a first heating element and a second heating element, the first and second heating elements positioned at a cooktop surface of the cooktop appliance; and a controller operably connected to the first and second heating elements, the controller configured for:

receiving a signal from a temperature sensor associated with a cooking utensil located on one of the first heating element and the second heating element, the signal indicative of a temperature associated with the cooking utensil;

activating the first heating element for a testing period;

monitoring the temperature associated with the cooking utensil during the testing period; and determining that the cooking utensil is located on the first heating element when a value of the monitored temperature is greater than a predefined threshold.

2. The cooktop appliance of claim 1, wherein the controller is further configured for generating a temperature setting, wherein activating the first heating element comprises setting a heating level of the first heating element to an ordinary level associated with the generated temperature setting, and wherein a duration of the testing period corresponds to the generated temperature setting.

3. The cooktop appliance of claim 2, wherein the controller is further configured for looking up the duration of the testing period in a lookup table.

4. The cooktop appliance of claim 1, wherein the value of the monitored temperature is a net increase in the monitored temperature.

5. The cooktop appliance of claim 1, wherein the value of the monitored temperature is a rate of increase in the monitored temperature.

6. The cooktop appliance of claim 1, wherein the value of the monitored temperature is an integral of the monitored temperature.

7. The cooktop appliance of claim 1, further comprising deactivating the first heating element and providing a notification when the value of the monitored temperature is less than the predefined threshold.

8. The cooktop appliance of claim 1, wherein activating the first heating element for the testing period comprises setting a heating level of the first heating element to an ordinary heating level corresponding to a user-selected low setting.

9. The cooktop appliance of claim 1, wherein the first heating element and the second heating element are part of a plurality of heating elements, and every heating element of the plurality of heating elements other than the first heating element is deactivated for the testing period.

10. The cooktop appliance of claim 1, wherein the controller is further configured for adjusting a heating level of the first heating element based on the received signal from the temperature sensor after determining that the cooking utensil is located on the first heating element.

11. A method of operating a cooktop appliance having a first heating element and a second heating element positioned at a cooking surface of the cooktop appliance, the method comprising:

receiving a signal from a temperature sensor associated with a cooking utensil located on one of the first heating element and the second heating element, the signal indicative of a temperature associated with the cooking utensil;

activating the first heating element for a testing period;

monitoring the temperature associated with the cooking utensil during the testing period; and determining that the cooking utensil is located on the first heating element when a value of the monitored temperature is greater than a predefined threshold.

12. The method of claim 11, further comprising generating a temperature setting, wherein activating the first heating element comprises setting a heating level of the first heating element to a user-selected level associated with the generated temperature setting, and wherein a duration of the testing period corresponds to the generated temperature setting.

13. The method of claim 12, further comprising looking up the duration of the testing period in a lookup table.

14. The method of claim 11, wherein the value of the monitored temperature is a net increase in the monitored temperature.

15. The method of claim 11, wherein the value of the monitored temperature is a rate of increase in the monitored temperature.

16. The method of claim 11, wherein the value of the monitored temperature is an integral of the monitored temperature.

17. The method of claim 11, further comprising deactivating the first heating element and providing a notification when the value of the monitored temperature is less than the predefined threshold.

18. The method of claim 11, wherein activating the first heating element for the testing period comprises setting a heating level of the first heating element to an ordinary heating level corresponding to a user-selected low setting.

19. The method of claim 11, wherein the first heating element and the second heating element are part of a plurality of heating elements, and every heating element of the plurality of heating elements other than the first heating element is deactivated for the testing period.

20. The method of claim 11, further comprising adjusting a heating level of the first heating element based on the received signal from the temperature sensor after determining that the cooking utensil is located on the first heating element.

* * * * *